US012472410B2

(12) United States Patent
Murrell et al.

(10) Patent No.: US 12,472,410 B2
(45) Date of Patent: Nov. 18, 2025

(54) HAND-HELD GOLF CLUB CLEANING DEVICE

(71) Applicant: FENDO GOLF, LLC, Atlanta, GA (US)

(72) Inventors: David Murrell, New York, NY (US); Connor Gans, Atlanta, GA (US)

(73) Assignee: Fendo Golf, LLC, Atlanta, GA (US)

( * ) Notice: Subject to any disclaimer, the term of this patent is extended or adjusted under 35 U.S.C. 154(b) by 395 days.

(21) Appl. No.: 18/168,158

(22) Filed: Feb. 13, 2023

(65) Prior Publication Data

US 2023/0256310 A1 Aug. 17, 2023

Related U.S. Application Data

(60) Provisional application No. 63/310,838, filed on Feb. 16, 2022.

(51) Int. Cl.

| | |
|---|---|
| ***A63B 57/60*** | (2015.01) |
| ***A46B 7/04*** | (2006.01) |
| ***A46B 9/02*** | (2006.01) |
| ***A46B 11/00*** | (2006.01) |
| ***A46B 15/00*** | (2006.01) |

(52) U.S. Cl.

CPC ..... *A63B 57/60* (2015.10); *A46B 7/04* (2013.01); *A46B 9/026* (2013.01); *A46B 11/0055* (2013.01); *A46B 11/0062* (2013.01); *A46B 15/0081* (2013.01); *A46B 2200/3073* (2013.01)

(58) Field of Classification Search

CPC ..... A63B 57/60; A46B 2200/3073

See application file for complete search history.

(56) References Cited

U.S. PATENT DOCUMENTS

| | | | | |
|---|---|---|---|---|
| 4,953,999 | A * | 9/1990 | Rivers | A63B 60/36 401/139 |
| 5,878,460 | A * | 3/1999 | Bruce | A63B 57/60 15/160 |
| 6,745,424 | B1 | 6/2004 | Pimentel et al. | |
| 7,162,766 | B1 | 1/2007 | Yakopcic | |
| 7,752,701 | B2 | 7/2010 | Bohannon et al. | |
| 8,918,943 | B2 | 12/2014 | Blaszczec | |
| 10,251,471 | B1 | 4/2019 | Sanderson | |
| D908,298 | S | 1/2021 | Sanderson | |
| 2002/0069472 | A1 | 6/2002 | Glass | |
| 2012/0227198 | A1 | 9/2012 | Blaszczec | |

FOREIGN PATENT DOCUMENTS

WO 2008032301 A2 3/2008

* cited by examiner

*Primary Examiner* — Shay Karls

(74) *Attorney, Agent, or Firm* — Andrus Intellectual Property Law, LLP

(57) ABSTRACT

A golf club cleaning device for cleaning a plurality of grooves formed on a striking face of the golf club head. The golf club cleaning device includes a head portion having a pair of side arms spaced from each other to define a cleaning pocket. Each of the side arms and an end wall includes a plurality of cleaning bristles that extend into the cleaning pocket such that the cleaning bristles can remove debris from the golf club head. A pump mechanism is included in a main body of the cleaning device. The pump mechanism is operable to direct a spray of cleaning fluid onto the golf club head in the cleaning cavity. An end cap is mounted to the main body to close an internal reservoir. The end cap includes a retractable groove tool that can be used to clean the grooves on the club head.

19 Claims, 7 Drawing Sheets

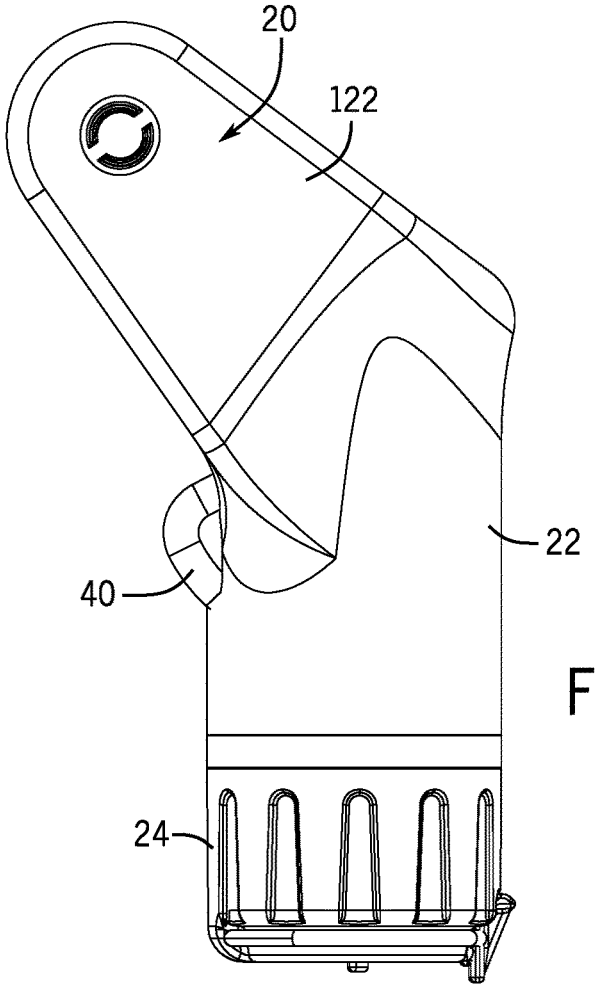
FIG. 5
FIG. 6
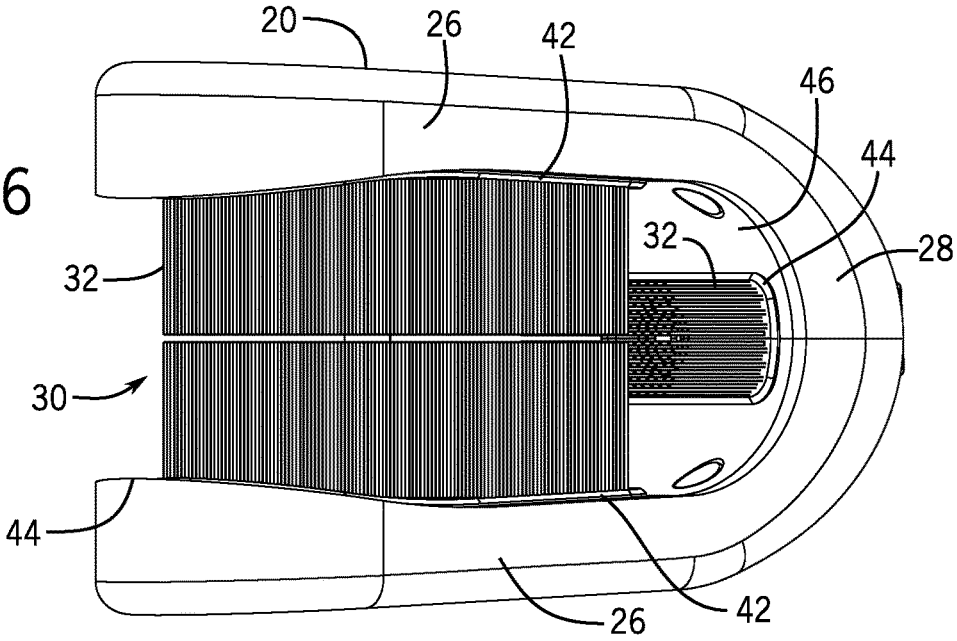

HAND-HELD GOLF CLUB CLEANING DEVICE

CROSS REFERENCE TO RELATED APPLICATIONS

The present application is based on and claims priority to U.S. Provisional Patent Application Ser. No. 63/310,838, filed Feb. 16, 2022, the disclosure of which is incorporated herein by reference.

BACKGROUND

The present disclosure generally relates to a golf club cleaning device for use in cleaning a golf club head having a plurality of grooves formed on a striking face of the golf club head. More specifically, the present disclosure relates to a hand-held golf club cleaning device that includes dual-side brushes or bristles and an internal supply of water to aid in cleaning an entire golf club, including the front and back.

Golf club irons have a series of individual grooves formed on the striking face that are used to impart spin onto a golf ball during a golf shot. The grooves on the striking face of an iron typically have a V-shape or U-shape and are spaced at a distance from each other that is dictated by the rules of golf. During the swing, as the club face strikes the ball, the grooves along the striking face impart spin onto the ball which aids in controlling the ball flight and the action of the ball once it strikes the ground, and particularly a putting green. During use, as debris, including dirt and grass, accumulates within the grooves, the performance characteristics of the striking face change. As debris gathers and fills the control grooves on the club face, control is lost and accuracy is adversely affected.

Therefore, it is important that during play and after a round, the striking face of an iron golf club is cleaned and the debris removed from all of the grooves. Typically a combination of a bucket of water and a brush are used to clean debris from the grooves on the striking face after a round. During a round, a wet towel is used by a many golfers to clean the striking face. However, a wet towel alone does not do an effective job of removing debris from within the grooves on the face. Although such systems are effective, it requires a supply of water and a cleaning brush for after a round and a wet towel during the round. It would be desirable to have a handheld device that would allow a user to remove debris from a golf club during a round or immediately after the round.

SUMMARY

The present disclosure generally relates to a golf club cleaning device for use in cleaning a golf club head having a plurality of grooves formed on a striking surface of the golf club head. More specifically, the present disclosure relates to a golf club cleaning device that includes a self-contained cleaning fluid, such as water, that can be applied to a golf club directly from the device during the cleaning process. The golf club cleaning device is designed to be hand-held and includes an internal cleaning pocket that has a series of bristle extending into the pocket from a plurality of different directions to provide complete coverage of the iron head.

The golf club cleaning device includes a head portion that has a pair of side arms that are spaced from each other. The side arms are joined to each other at inner ends by a curved end wall such that the side arms and the end wall define a cleaning pocket. A plurality of bristles are positioned to extend into the cleaning pocket from each of the side arms and the end wall. The plurality of bristles are divided between separate bristle pads that are each mounted to either one of the side arms or the end wall. In some embodiments, the separate bristle pads can be removed and replaced when the individual bristles become worn due to extended use of the golf club cleaning device.

The golf club cleaning device further includes a main body that is joined to the head portion. The main body is designed to include an internal reservoir that is configured to receive a supply of cleaning fluid, such as water.

The golf club cleaning device further includes a pump mechanism that can be operated by a user to draw the cleaning solution from the reservoir and direct a spray of the cleaning solution onto the golf club as the club is being cleaned by the bristles.

In one exemplary embodiment, the golf club cleaning device includes an end cap that is removably mounted to an open end of the main body. The end cap includes a groove tool that is movable between a retracted position and an extended position. In the extended, use position a tapered outer end extends from the end cap. The outer end includes a cleaning point that can be used to remove debris from the grooves of the striking face of the golf club.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 5 is a side view of the golf club cleaning device;

FIG. 6 is a top view of the golf club cleaning device;

DETAILED DESCRIPTION

Figure 1:
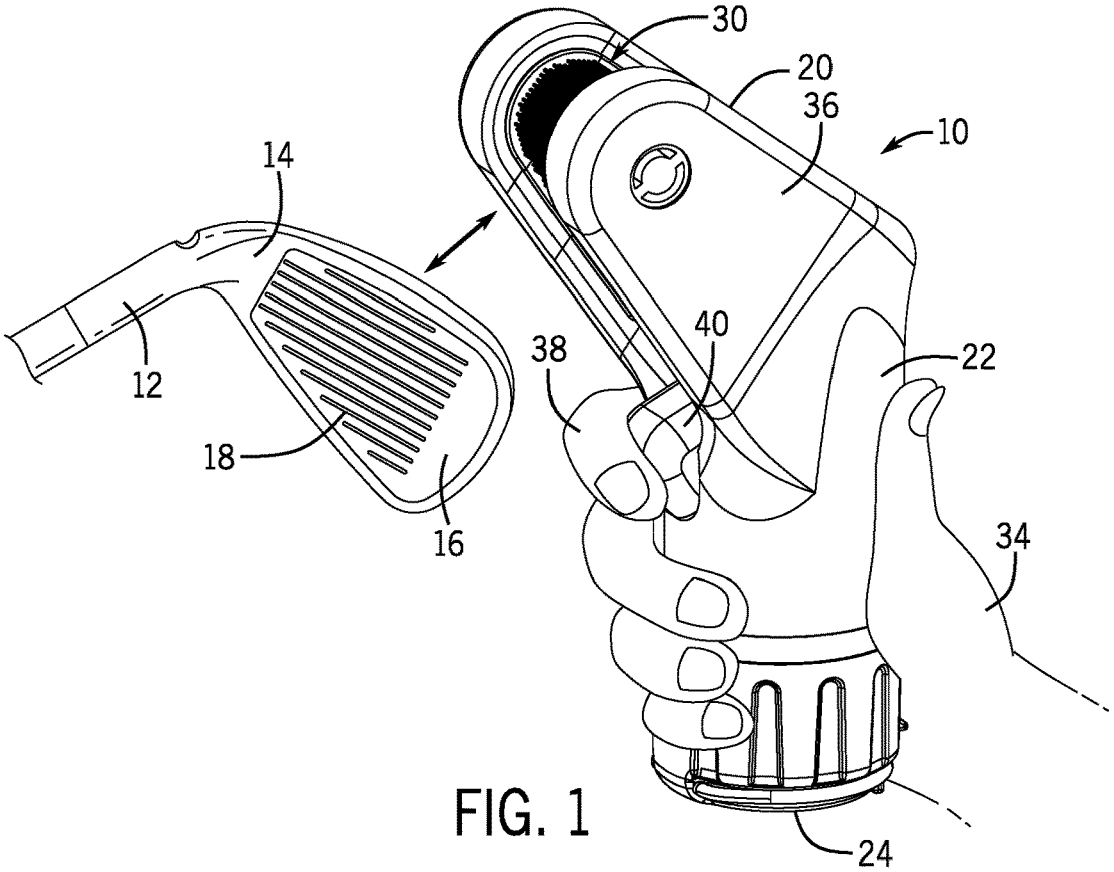
FIG. 1 is a front perspective view of a hand-held golf club cleaning device being used to clean a golf club in accordance with the present disclosure.

FIG. 1 illustrates a golf club cleaning device 10 constructed in accordance with the present disclosure. The golf club cleaning device 10 is designed to be used to remove dirt or other debris from a golf club 12, such as an iron golf club as shown in FIG. 1. The golf club 12 includes a club head 14 that includes a striking face 16 having a plurality of individual grooves 18 space from each other. During use of the golf club 12 during a round of golf or during practice, the individual grooves 18 formed on the striking face 16 can become filled with debris, mud and grass and need to be cleaned to provide optimum performance of the golf club 12.

The golf club cleaning device 10 includes a golf club cleaning head portion 20 that is joined to a main body 22. The main body 22 is designed to include and surround an internal reservoir that includes an open interior sized and designed to receive a supply of a cleaning fluid, such as water. The internal reservoir contained within the main body 22 can be filled after the removal of an end cap 24. When the end cap 24 is removed, the cleaning fluid can be poured into the internal reservoir and sprayed onto the golf club 12 during the cleaning process utilizing the cleaning device 10 of the present disclosure, as will be described in greater detail below.

Figure 3:
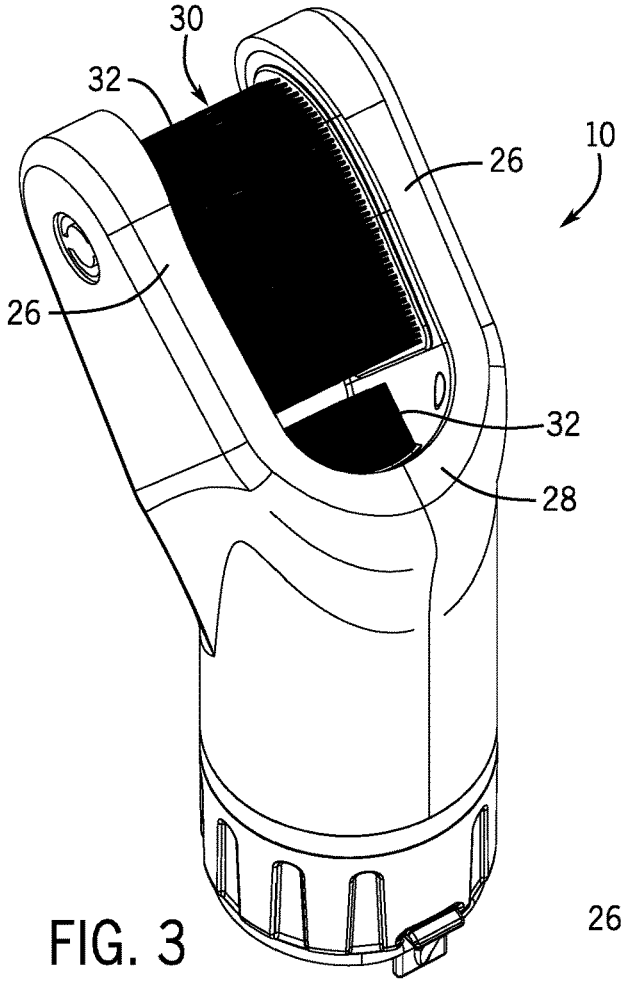
FIG. 3 is a top, back perspective view of the hand-held golf club cleaning device.
Figure 4:
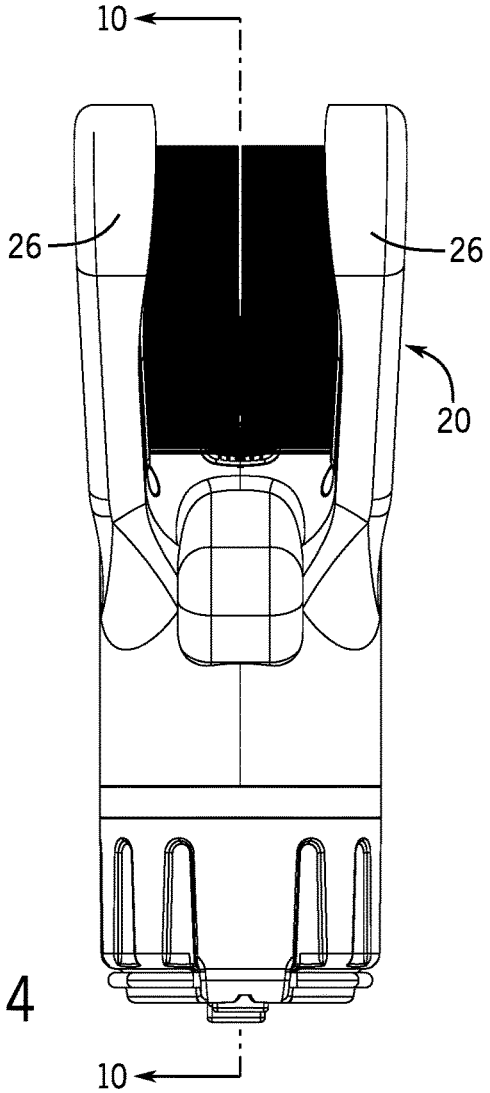
FIG. 4 is a front view of the hand-held golf club cleaning device.

As shown in FIGS. 3 and 4, the head portion 20 includes a pair of side arms 26 that are generally parallel to each other and are spaced from each other. The outer end of each of the side arms 26 are spaced from each other while the inner ends of each of the pair of side arms 26 are joined to each other by a curved end wall 28. In this manner, the combination of the pair of side arms 26 and the curved end wall 28 define an open cleaning pocket 30 that is sized to receive the golf club head 14.

As illustrated in the views of FIGS. 3 and 4, both of the side arms 26 and the curved end wall 28 include a set of bristles 32 that extend into the open cleaning pocket 30 for use in cleaning the dirty surfaces of the golf club to remove the dirt and debris from the golf club during use by a player or subsequent to such use by the player. The bristles 32 are formed from a flexible material that is stiff enough to clean the golf club without damaging the striking surface.

As shown in the in-use illustration of FIG. 1, a user 34 grasps the golf club cleaning device 10 with one hand while holding the golf club 12 with the other. In this position, the user is able to support the golf club cleaning device such that the golf club 12 can be moved into the cleaning pocket 30 for cleaning. Although shown in one orientation in FIG. 1, it is contemplated that the golf club cleaning device 10 could be inverted and used in another orientation in which the end cap 24 is upward. In such orientation, the user would grasp the outer surface 36 of each of the pair of spaced side arms 26. As illustrated in the use position shown in FIG. 1, an index finger 38 is positioned resting upon a trigger 40 such that the user can repeatedly depress the trigger 40 to cause the cleaning solution to be sprayed on the golf club that is located within the cleaning pocket 30. The operation of the trigger 40 by the user will spray the cleaning fluid onto the golf club in a manner that will be described in further detail below.

In the in-use position shown in FIG. 1, the user can use his or her hand to move the golf club 12 between the series of spaced bristles 32 to remove the dirt and debris from the club head 14. This can occur even without spraying the cleaning fluid onto the golf club. As can be understood in the images of FIGS. 3-4, the bristles 32 are distributed between three sets of bristle pads such that the bristles extend in three different directions into the cleaning pocket 30. In this manner, the bristles 32 will contact the golf club head 14 on multiple surfaces simultaneously during the cleaning process. The specific shape and configuration of the golf club cleaning device 10 allows for easy and convenient use by the user. The multi-sided bristles 32 and the two gripping areas on either side of the side arms 26 allow the user to apply pressure to the golf club head being cleaned. The pressure allows the user to quickly and thoroughly clean all of the surfaces of the golf club.

Referring now to FIG. 6, each of the side arms 26 is designed to receive a bristle pad 42 that includes the plurality of individual bristles 32 extending therefrom. The bristle pads 42 each include a series of bristle openings that are designed to allow individual bristles to extend through the bristle pad 42 and into the cleaning pocket 30 when the bristle pads 42 are attached to the side arms 26. A similar bristle pad 44 is mounted to the inner surface 46 on the curved end wall 28. The bristle pad 44 includes a similar series of bristles 32. However, the bristle pad 44 mounted to the inner surface 46 of the end wall 28 is sized smaller than the bristle pads 42 mounted to the inner surface 46 formed on each of the side arms 26. It is contemplated that the head portion 20, including the pair of spaced side arms 26, would be a molded component and that the side bristle pads 42 and the end bristle pad 44 would be installed along the inner surface that defines the cleaning pocket 30 after the head portion 20 has been molded. However, it is contemplated that the bristle pads could be installed in a different manner, or as insertable bristle brush pads, as long as individual bristles extend in multiple directions into the club cleaning pocket 30.

In one contemplated embodiment, each of the bristle pads 42 is designed to be replaceable when the individual bristles 32 become worn during extended use of the golf club cleaning device 10. The bristle pads 42 would be designed to securely snap or clip into place and be held securely in place during use. When the bristles 32 become worn, the bristle pads 42 could be removed and replaced with new bristle pads 42. It is contemplated that the bristle pads 42 could be replaced every year or couple of years to maintain the effectiveness of the golf club cleaning device 10. The use of removable bristle pads 42 would thus extend the life of the golf club cleaning device 10.

Figure 9:
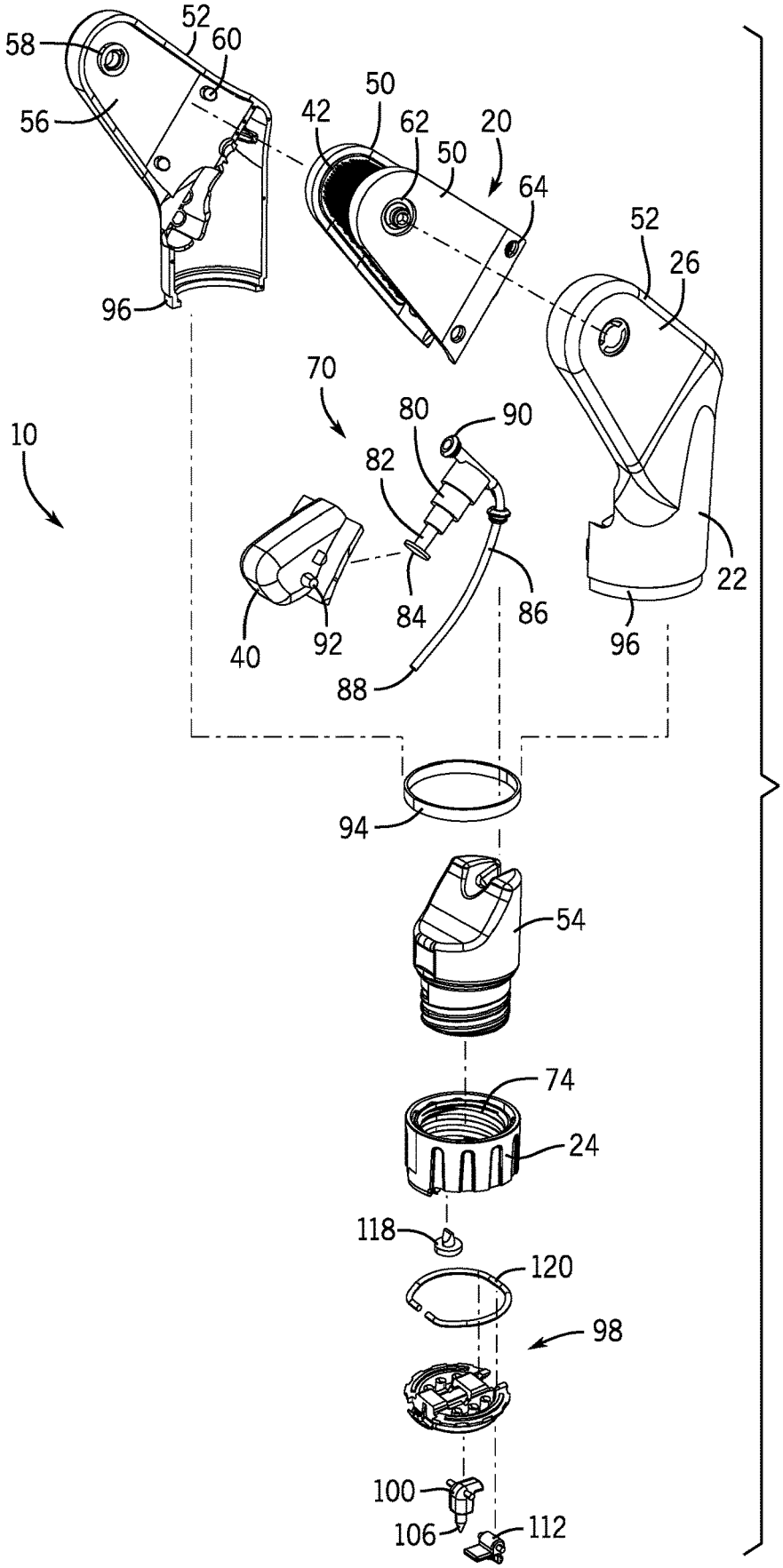
FIG. 9 is an exploded view of the golf club cleaning device.

FIG. 9 illustrates an exploded view of the club cleaning device 10 of the present disclosure. As illustrated in FIG. 9, the head portion 20 includes a pair of mounting plates 50 that are each designed to receive one of the bristle pads 42. The mounting plates 50 are each designed and sized to be received between a pair of molded housings 52 that each define both the outer supports of the side arms 26 and the outer portion of the main body 22. When assembled, the main body 22 portions of the molded housings surround the internal reservoir 54. The internal reservoir 54 is designed as a separate component received within the mated molded housings 52 such that the internal reservoir 54 is surrounded by and enclosed by the pair of outer housings. The internal reservoir 54 is concealed within the main body 22 and is accessible from the open bottom end of the main body 22.

As shown in FIG. 9, the internal surface 56 of the pair of housings 52 includes a circular receiving cavity 58 and a pair of alignment tabs 60. The combination of the receiving cavity 58 and the receiving cavity 58 receive a post 62 on the mounting plate 50. At the same time, the alignment tabs 60 are received within openings 64 formed in the mounting plate 50. When the pair of housings 52 are mated with each other, the mated housings 52 hold the pair of mounting plates 50 in the condition shown in the drawing figures.

Figure 10:
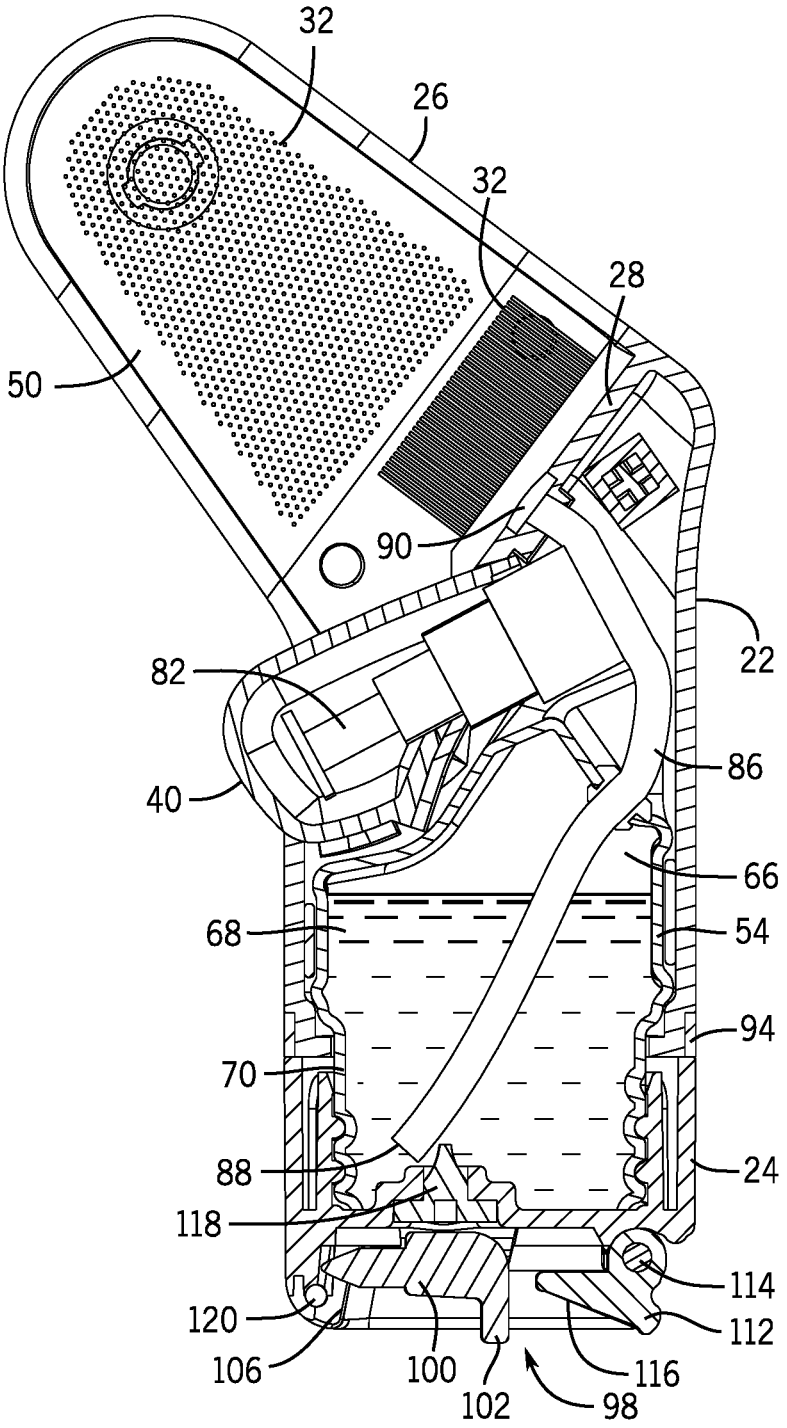
FIG. 10 is section view of the golf club cleaning device taken along line 10-10 of FIG. 4.
Figure 11:
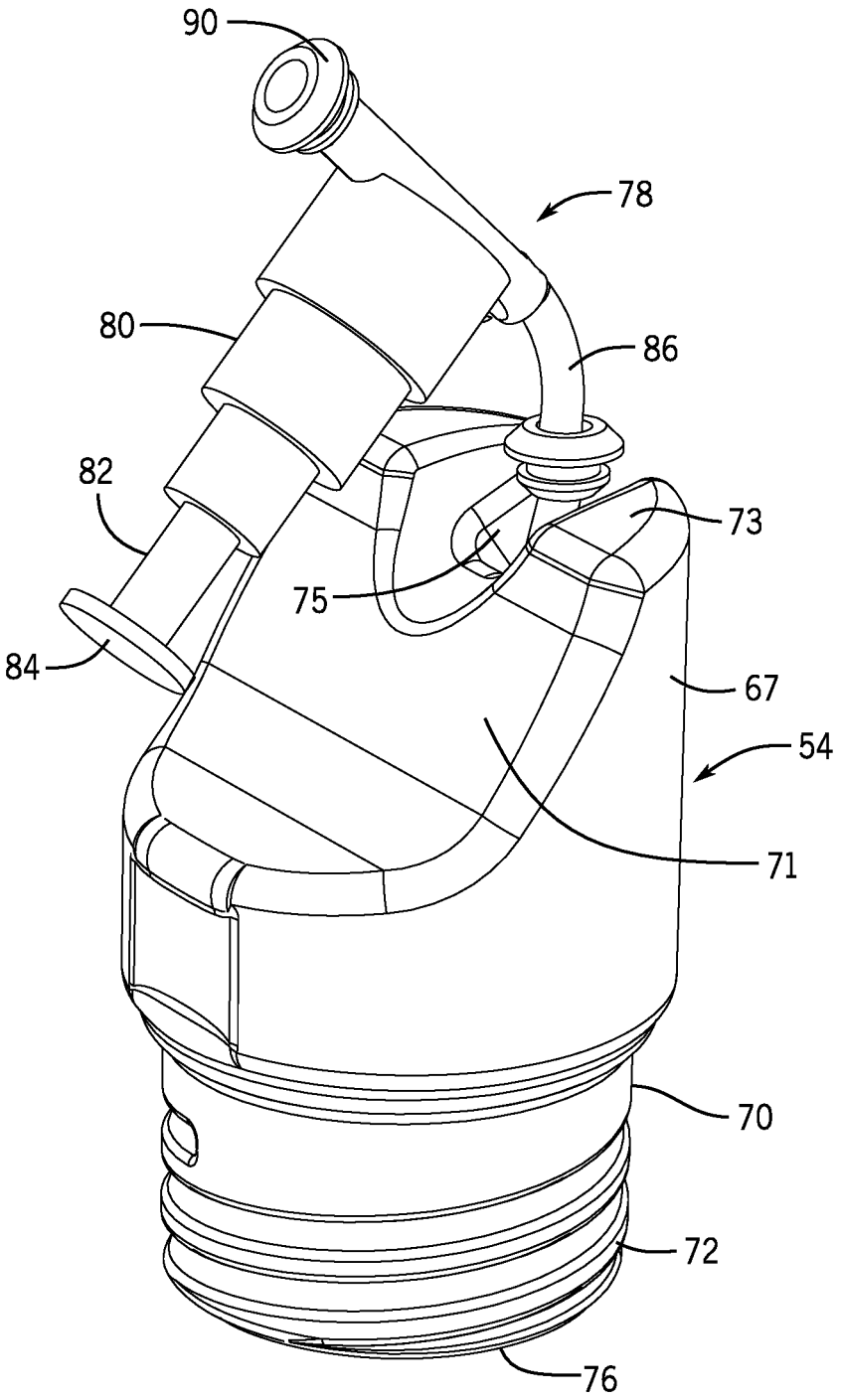
FIG. 11 is a view of the pump mechanism used to spray a cleaning fluid onto the golf club during cleaning.

FIGS. 9 and 11 illustrate the configuration of the internal reservoir 54 that is used as part of the golf club cleaning device of the present disclosure. The internal reservoir 54 includes an open interior 66, as best shown in FIG. 10. The open interior 66 is designed to receive a cleaning solution 68. In the embodiment illustrated and contemplated, the cleaning solution 68 can be a supply of water, although other liquids could be used within the scope of the present disclosure.

Referring back to FIG. 11, the reservoir 54 is formed as a molded plastic component and includes an upper portion 67 and a reduced diameter receiving portion 70 that includes a series of external threads 72. The external threads 72 are designed to receive corresponding internal threads 74 formed on the inner surface of the end cap 24, as illustrated in FIG. 9. The lower end 76 of the reservoir 54 is open such that the cleaning fluid can be poured into the internal reservoir 54 when the end cap is not present, as shown in FIG. 11. After the cleaning solution is poured into the open interior 66, the end cap 24 is tightened onto the receiving portion 70 to seal the open interior 66, as best shown in FIG. 10. It is contemplated that the materials selected from the end cap 24 and the reservoir are flexible enough to create a fluid tight seal between the end cap 24 and the reservoir 54.

As shown in FIG. 11, the upper portion 67 of the reservoir 54 includes a curved front surface 71 that is designed to accommodate the movement of the trigger. The curved front surface extends to a top end 73 that includes a recessed receiving slot 75. As will be described below, the receiving slot provides a point of access for the pumping mechanism used to discharge the cleaning fluid from the reservoir 54.

Referring now to FIGS. 9-11, the cleaning device 10 of the present disclosure further includes a pump mechanism 78 that can be manually operated by the user to discharge the cleaning fluid 68 from the open interior 66 of the reservoir 54 for application to the golf club. The pump mechanism 78 includes a pump cylinder 80 having a movable plunger 82. The movable plunger 82 includes an internal piston that creates a seal with the interior of the pump cylinder to create a suction during movement of the plunger 82 within the cylinder 80. The plunger 82 includes a head 84 that provides a point of contact for moving the plunger 82.

The movable plunger 82 is movable into and out of the pump cylinder 80. During this movement, the internal piston that is part of the plunger 82 creates a supply of suction that draws the stored fluid from within the open interior of the reservoir 54 through a discharge tube 86. As shown in FIG. 10, the end 88 of the discharge tube 86 is submerged within the cleaning solution 68. When the plunger 82 is depressed, the internal piston of the plunger 82 creates a source of suction that draws the cleaning solution 68 through the discharge tube 86.

The opposite end of the discharge tube 86 includes a spray head 90. As shown in FIG. 10, the spray head 90 is positioned amongst the series of bristles 32 mounted to the end wall 28 defining the cleaning pocket. Thus, when the plunger 82 is depressed, the cleaning solution is drawn out of the open interior 66 and is sprayed out of the spray head 90. Since the spray head 90 is located within the cleaning pocket, the cleaning solution will be sprayed into the cleaning pocket. If a golf club head is within the cleaning pocket, the cleaning solution will be sprayed onto the golf club head.

Referring back to FIGS. 9 and 10, the pump mechanism 78 further includes a trigger 40 that is mounted to extend between the intersection between the side arms 26 and the main body 22. The trigger 40 includes a pair of pivot pins 92 that allow the entire trigger 40 to pivot upon the application of force by a user. When the trigger 40 pivots, the trigger 40 depresses the plunger 82 as can be understood in FIG. 10. When the plunger 82 is depressed, the internal piston of the plunger 82 creates a negative pressure within the cylinder 80, which draws the cleaning solution 68 from the open interior 66. Repeated depressions of the trigger 40 will cause additional amounts of the cleaning solution to be expressed from the spray head 90. In this manner, the user can depress the trigger 40 the required number of times to supply the required amount of cleaning solution to the golf club head during use.

As shown in FIGS. 9 and 10, the cleaning device 10 further includes a retaining ring 94 that is designed to surround the bottom edge 96 of the pair of mated outer housings 52 to aid in preventing separation of the outer housings 52 during use. The retaining ring 94 is positioned slightly above the end cap 24 when the end cap is installed as shown in FIG. 10.

Figure 7:
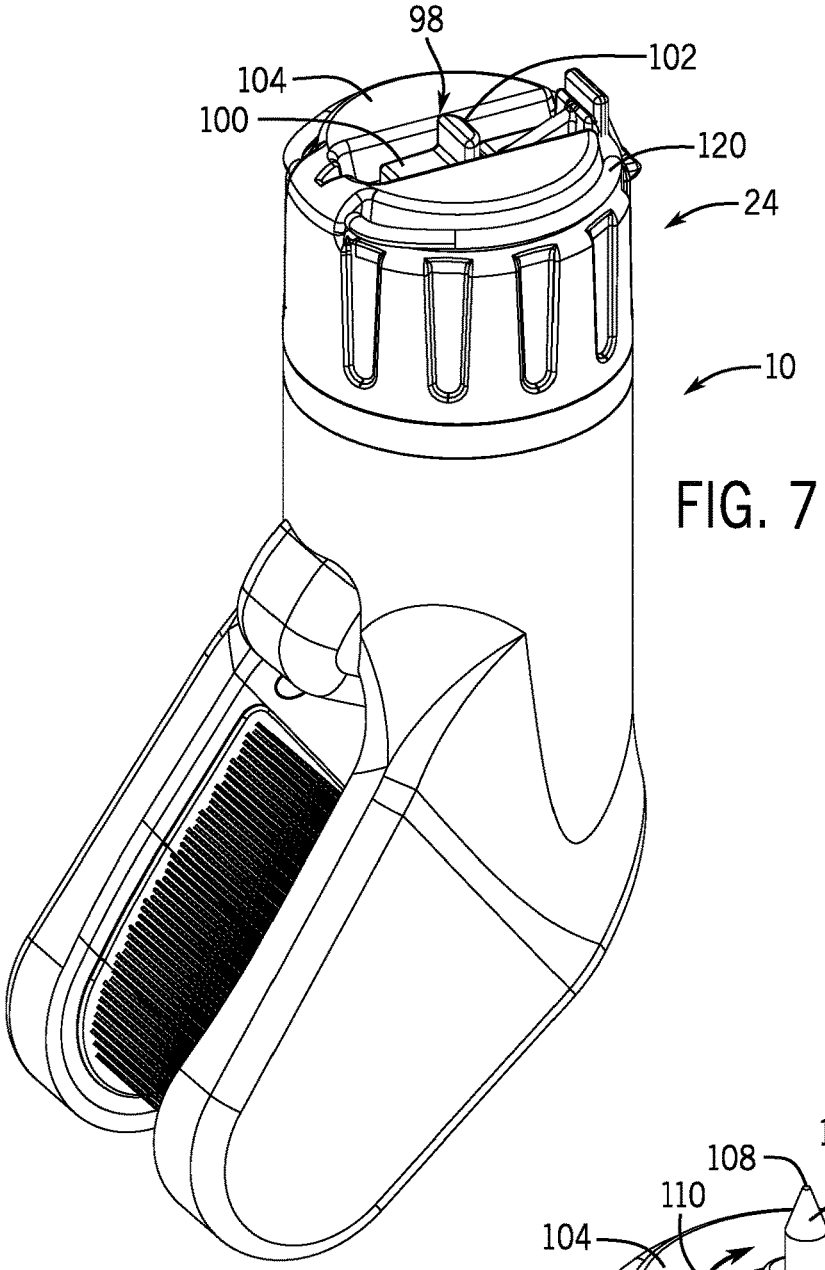
FIG. 7 is a bottom view showing the groove tool in a retracted position.
Figure 8:
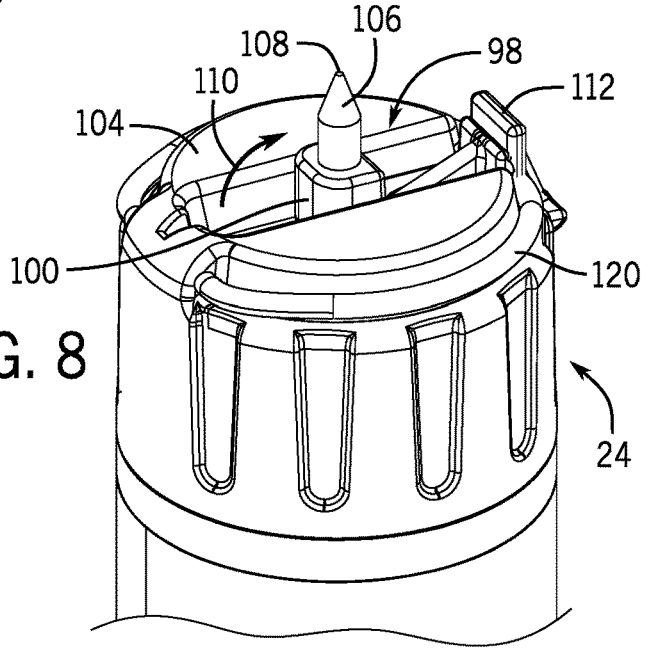
FIG. 8 is a magnified view showing the groove tool in an extended, operating condition.

FIGS. 7 and 8 illustrate the configuration of the end cap 24 in accordance with the present disclosure. In the embodiment shown in FIG. 7, the end cap 24 is configured including a groove tool 98 that is movable between the retracted position of FIG. 7 and the extended, operating position shown in FIG. 8. The groove tool 98 includes a main body 100 having an engagement tab 102. The engagement tab 102 extends past the outer surface 104 of the end cap 24 in the retracted position. The engagement tab 102 provides an engagement area for the user to move the groove tool 98 from the retracted position to the extended position. In the extended position shown in FIG. 8, a tapered outer end 106 extends well past the outer surface 104. The tapered outer end 106 terminates in a cleaning point 108. The cleaning point 108 preferably has a size such that it can be received within the individual grooves on the striking face of the golf club head. The tapered outer end 106 including the cleaning point 108 is formed from a durable metallic material that will resist wear during use. If the cleaning point 108 is small enough, the cleaning point will be able to be received within the grooves and used by the user to clean debris and dirt from the grooves. As shown in FIG. 8, the arrow 110 illustrates the pivoting movement of the groove tool to the extended, operating position.

Referring now to FIGS. 8 and 10, the groove tool 98 includes a latch 112 that is pivotally mounted about a pin 114. The latch 112 is spring-biased into the latching position shown in FIG. 10. When the engagement tab 102 is depressed by the user, the engagement tab pivots and contacts the outer surface 116 of the latch 112. The main body 100 continues to pivot until the engagement tab 102 passes below the latch 112. The latch is spring-biased to return to the position shown in FIG. 10. In this manner, the latch 112 is able to securely retain the body 100 and the outer end 106 in the extended position shown in FIG. 8. To release the groove tool, the user again depresses the latch 112 and the main body can pivot back to the retracted position shown in FIG. 9.

Referring now to FIGS. 9 and 10, the groove tool 98 further includes a resilient plug 118 that is used to create an outward bias force against the body 100 when the groove tool is in the retracted position. The plug 118 is formed from a resilient material. A retaining ring 120 is shown installed around the end cap. The ring 120 can be released to allow the user to hang the entire cleaning device 10 in a desired location.

Figure 2:
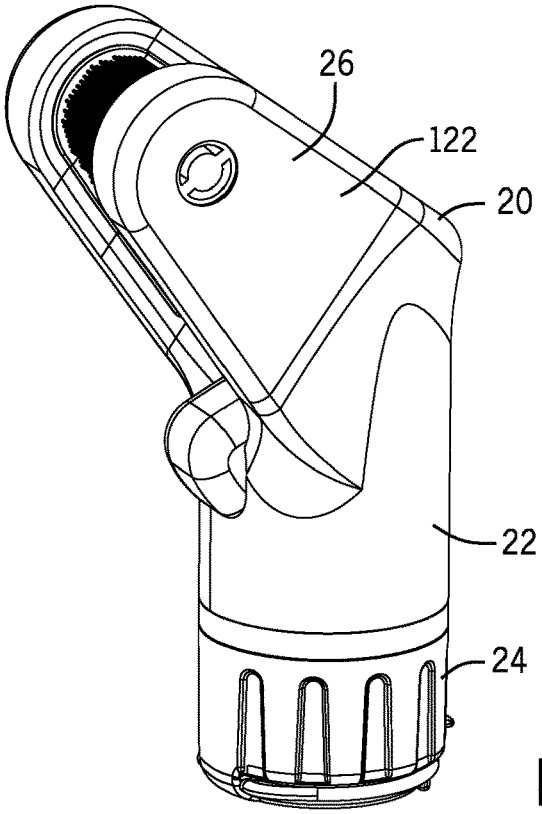
FIG. 2 is a front perspective view of the hand-held golf club cleaning device.

In an exemplary embodiment shown and described, the main body is designed to be created by two injection molded parts that are vibration-welded together to create the main housing that surrounds the internal reservoir 54. In the embodiment shown in the drawing figures, the main body is a TPU-based material that can include a silicone over-mold in at least the gripping areas 122 shown in FIGS. 2 and 5. The gripping areas 122 can include a silicone/textured wrap that will allow for printing and customization on the exterior of the device. The use of such an exterior layer will allow for logos, words and other messages to be printed onto the device for customization and commercialization as desired.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A golf club cleaning device for use in cleaning a golf club head having a plurality of grooves formed on a striking face of the golf club head, comprising:

a golf club cleaning head portion including a pair of side arms spaced from each other and joined to each other at inner ends by a curved end wall, wherein the pair of side arms and the end wall define a cleaning pocket;

a plurality of bristles extending into the cleaning pocket from each of the pair of spaced side arms;

a main body joined to the head portion and extending below a first side edge of each side arm of the head portion, the main body including an internal reservoir configured to receive a supply of cleaning solution; and a pump mechanism contained within the main body and operable to direct the cleaning solution from the internal reservoir to the cleaning pocket.

2. The golf club cleaning device of claim 1 further comprising a plurality of bristles extending into the cleaning pocket from the curved end wall.

3. The golf club cleaning device of claim 2 further comprising a plurality of bristle pads that each include a portion of the plurality of bristles extending into the cleaning pocket from the pair of spaced side walls and the curved end wall.

4. The golf club cleaning device of claim 3 wherein each of the plurality of bristle pads are removable and replaceable.

5. The golf club cleaning device of claim 1 wherein the pump mechanism includes a spray head extending through the curved end wall.

6. The golf club cleaning device of claim 5 wherein the pump mechanism includes a trigger positioned below a first side edge of each side arm of the head portion and extending from an outer wall of the main body, wherein depression of the trigger operates a plunger to pump the cleaning solution from the internal reservoir to the spay head.

7. The golf club cleaning device of claim 1 wherein each of the side arms is formed from a molded plastic material, wherein each of the side arms includes an outer surface having a slip resistant material molded over the plastic material.

8. A golf club cleaning device for use in cleaning a golf club head having a plurality of grooves formed on a striking face of the golf club head, comprising:

a golf club cleaning head portion including a pair of side arms spaced from each other and joined to each other at inner ends by a curved end wall, wherein the pair of side arms and the end wall define a cleaning pocket;

a plurality of bristles extending into the cleaning pocket from each of the pair of spaced side arms;

a main body joined to the head portion and extending below a first side edge of each side arm of the head portion, the main body including an internal reservoir configured to receive a supply of cleaning solution;

a pump mechanism contained within the main body and operable to direct the cleaning solution from the internal reservoir to the cleaning pocket; and an end cap removably mounted to an open end of the main body such that removal of the end cap provides access to the internal reservoir.

9. The golf club cleaning device of claim 8 further comprising a groove tool mounted to the end cap.

10. The golf club cleaning device of claim 9 wherein the groove tool includes a tapered outer end that defines a cleaning point sized to be received within the grooves of the striking face.

11. The golf club cleaning device of claim 9 wherein the tapered outer end is formed from a metallic material.

12. The golf club cleaning device of claim 8 further comprising a plurality of bristles extending into the cleaning pocket from the curved outer wall.

13. A golf club cleaning device for use in cleaning a golf club head having a plurality of grooves formed on a striking face of the golf club head, comprising:

a golf club cleaning head portion including a pair of side arms spaced from each other and joined to each other at inner ends by a curved end wall, wherein the pair of side arms and the end wall define a cleaning pocket sized to receive the golf club head;

a plurality of bristles extending into the cleaning pocket from each of the pair of spaced side arms and the curved end wall;

a main body joined to the head portion, the main body including an internal reservoir configured to receive a supply of cleaning solution;

a pump mechanism contained within the main body and including a spray head extending into the cleaning pocket, wherein the pump mechanism is operable to direct the cleaning solution from the internal reservoir into the cleaning pocket;

an end cap removably mounted to an open end of the main body such that removal of the end cap provides access to the internal reservoir; and a groove tool mounted to the end cap and movable between a retracted position and an extended position.

14. The golf club cleaning device of claim 13 wherein the pump mechanism includes a trigger extending from an outer wall of the main body, wherein depression of the trigger operates a plunger to pump the cleaning solution from the internal reservoir to the spay head.

15. The golf club cleaning device of claim 13 wherein each of the side arms is formed from a molded plastic material, wherein each of the side arms includes an outer surface having a slip resistant material molded over the plastic material.

16. The golf club cleaning device of claim 13 wherein the groove tool includes a tapered outer end that defines a cleaning point sized to be received within the grooves of the striking face.

17. The golf club cleaning device of claim 16 wherein the tapered outer end is formed from a metallic material.

18. The golf club cleaning device of claim 13 further comprising a plurality of bristle pads that each include a portion of the plurality of bristles extending into the cleaning pocket from the pair of spaced side walls and the curved end wall.

19. The golf club cleaning device of claim 18 wherein each of the plurality of bristle pads are removable and replaceable.

* * * * *